US006135179A

United States Patent [19]

Joyner

[11] Patent Number: 6,135,179

[45] Date of Patent: Oct. 24, 2000

[54] HANDBAG HAVING AN EXTERNAL TRANSPARENT POCKET WITH AN INTERCHANGEABLE CLOCK THEREIN AND VISIBLE THERETHROUGH

[75] Inventor: Patricia Joyner, 15 Richard Ter. North, Union, N.J. 07083

[73] Assignee: Patricia Joyner, Union, N.J.

[21] Appl. No.: 09/336,024

[22] Filed: Jun. 18, 1999

[51] Int. Cl.[7] ..... A45C 3/06; A45C 15/08

[52] U.S. Cl. ..... 150/106; 150/104; 150/118; 383/106

[58] Field of Search ..... 150/100, 101, 150/103, 104, 106, 117, 118, 119, 112; 383/106

[56] References Cited

U.S. PATENT DOCUMENTS

| | | | |
|---|---|---|---|
| 1,435,704 | 11/1922 | Fisher | 150/106 X |
| 1,560,442 | 11/1925 | Trowbridge | 150/106 X |
| 1,835,749 | 12/1931 | Behrman | 150/106 |
| 1,949,936 | 3/1934 | Haynsworth et al. | 150/104 |
| 2,055,852 | 9/1936 | Resnick | 150/106 X |
| 2,172,695 | 9/1939 | Brody | 150/117 |
| 2,920,671 | 1/1960 | Siris et al. | 150/103 X |
| 3,556,187 | 1/1971 | Speakes | 150/104 X |
| 4,022,261 | 5/1977 | Russell | 383/106 X |
| 4,027,710 | 6/1977 | Keebler | 150/103 |
| 4,084,085 | 4/1978 | Kim | 150/106 X |
| 4,154,275 | 5/1979 | Cauley | 150/106 |
| 4,236,559 | 12/1980 | Archbold | 150/106 X |

FOREIGN PATENT DOCUMENTS

| | | | |
|---|---|---|---|
| 2406969 | 6/1979 | France | 150/104 |

*Primary Examiner*—Sue A. Weaver

[57] ABSTRACT

An accessory for clothing. The accessory includes a handbag, a pocket, a clock, and apparatus. The pocket is transparent and disposed externally on the handbag. The clock is maintained in the pocket and is visible therethrough. The clock is interchangeably maintained in the pocket for coordinating the clock with the clothing. The apparatus interchangeably maintains the clock in the pocket.

5 Claims, 1 Drawing Sheet

HANDBAG HAVING AN EXTERNAL TRANSPARENT POCKET WITH AN INTERCHANGEABLE CLOCK THEREIN AND VISIBLE THERETHROUGH

BACKGROUND OF THE INVENTION

1. Field of the Invention

The present invention relates to a handbag. More particularly, the present invention relates to a handbag having an external transparent pocket with an interchangeable clock therein and visible therethrough.

2. Description of the Prior Art

Numerous innovations for handbags have been provided in the prior art that will be described. Even though these innovations may be suitable for the specific individual purposes to which they address, however, they differ from the present invention in that they do not teach a handbag having an external transparent pocket with an interchangeable clock therein and visible therethrough.

FOR EXAMPLE, U.S. Pat. No. Des. 247,069 to Siris teaches the ornamental design for a side pocket for a handbag or the like.

ANOTHER EXAMPLE, U.S. Pat. No. Des. 268,304 to Schimmel teaches the ornamental design for a combined handbag and clock.

STILL ANOTHER EXAMPLE, U.S. Pat. No. Des. 375,625 to Kieselstein-Cord teaches the ornamental design for a combined watch and handbag.

FINALLY, YET ANOTHER EXAMPLE, U.S. Pat. No. 4,154,275 to Cauley teaches a hand bag that includes a pocket book and a change purse in which the change purse is connected to the pocket book by a chain in which a watch is interposed. The chain is connected at one end to a metal frame extending about the rim of one of the pivotal sides or flaps of the opening into the main pocket of the pocket book and at the other end to the metal frame extending about one of the pivotal flaps of the opening of the pocket in the change purse. The watch is visible with the change purse in or out of the pocket.

It is apparent that numerous innovations for handbags have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a handbag having an external transparent pocket with an interchangeable clock therein and visible therethrough that avoids the disadvantages of the prior art.

ANOTHER OBJECT of the present invention is to provide a handbag having an external transparent pocket with an interchangeable clock therein and visible therethrough that is simple and inexpensive to manufacture.

STILL ANOTHER OBJECT of the present invention is to provide a handbag having an external transparent pocket with an interchangeable clock therein and visible therethrough that is simple to use.

BRIEFLY STATED, YET ANOTHER OBJECT of the present invention is to provide an accessory for clothing. The accessory includes a handbag, a pocket, a clock, and apparatus. The pocket is transparent and disposed externally on the handbag. The clock is maintained in the pocket and is visible therethrough. The clock is interchangeably maintained in the pocket for coordinating the clock with the clothing. The apparatus interchangeably maintains the clock in the pocket.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
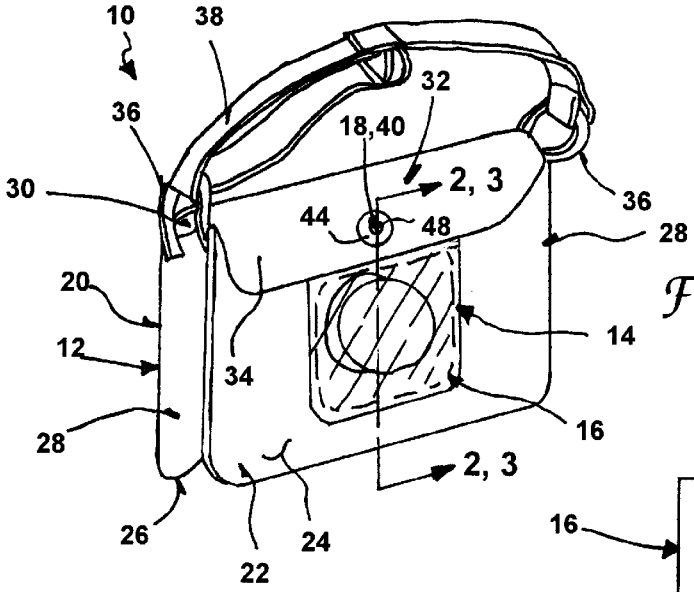
FIG. 1 is a diagrammatic perspective view of the present invention.

10 handbag having an external transparent pocket with an interchangeable clock therein and visible therethrough of the present invention
12 handbag
14 pocket
16 clock
18 first apparatus for interchangeably maintaining clock 16 in pocket 14
20 rear panel of handbag 12 for facing user
22 front panel of handbag 12
24 external surface of front panel 22 of handbag 12 for facing ambient
26 bottom panel of handbag 12
28 pair of accordion gussets of handbag 12
30 open top of handbag 12
32 flap of handbag 12
34 front portion of flap 32 of handbag 12
36 pair of side loops of handbag 12
38 adjustable shoulder strap of handbag 12
40 second apparatus of handbag 12 for selectively maintaining front portion 34 of flap 32 of handbag 12 engaged with front panel 22 of handbag 12
42 throughbore in front portion 34 of flap 32 of handbag 12 of second apparatus 40
44 first eyelet of second apparatus 40
46 back plate of second apparatus 40
48 turn-lock of second apparatus 40
50 open top of pocket 14
52 throughopening in pocket 14 of first apparatus 18
54 second eyelet of first apparatus 18

DETAILED DESCRIPTION OF THE PREFERRED EMBODIMENT

Referring now to the figures, in which like numerals indicate like parts, and particularly to FIG. 1, which is a diagrammatic perspective view of the present invention, the handbag having an external transparent pocket with an interchangeable clock therein and visible therethrough of the present invention is shown generally at 10.

Figure 2:
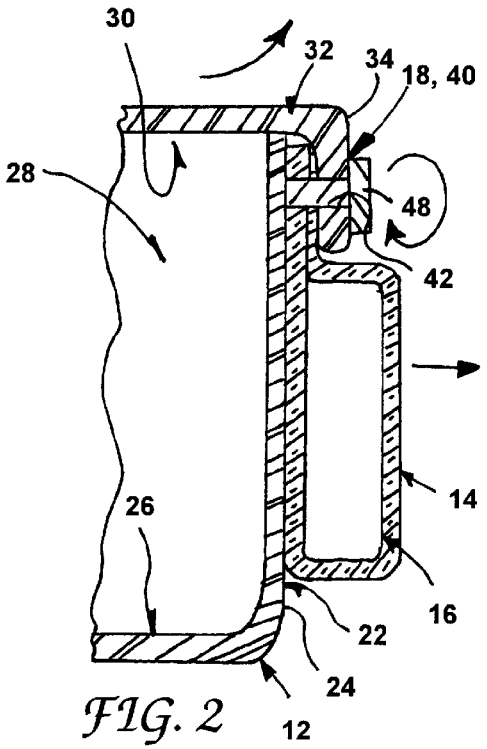
FIG. 2 is an enlarged exaggerated cross sectional view taken on LINE 2—2 in FIG. 1, with the pocket of the present invention in the closed mode.
Figure 3:
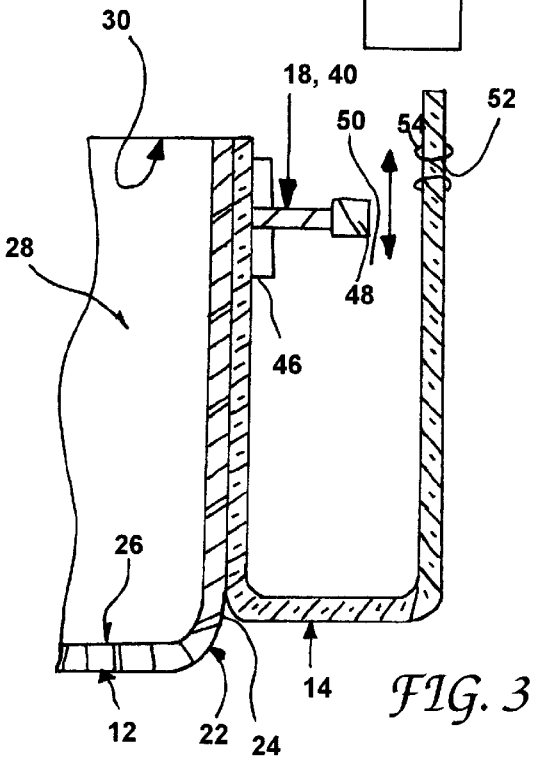
FIG. 3 is an enlarged exaggerated cross sectional view taken on LINE 3—3 in FIG. 1, with the pocket of the present invention in the open mode.

The configuration of the handbag having an external transparent pocket with an interchangeable clock therein and visible therethrough 10 can best be seen in FIGS. 1–3, which are, respectively, again a diagrammatic perspective view of the present invention, an enlarged exaggerated cross sectional view taken on LINE 2—2 in FIG. 1, with the pocket of the present invention in the closed mode, and an enlarged exaggerated cross sectional view taken on LINE 3—3 in FIG. 1, with the pocket of the present invention in the open mode, and as such, will be discussed with reference thereto.

The handbag having an external transparent pocket with an interchangeable clock therein and visible therethrough 10 comprises a handbag 12, a pocket 14 being transparent and disposed externally on the handbag 12, a clock 16 maintained in the pocket 14 and visible therethrough, with the clock 16 being interchangeably maintained in the pocket 14 for coordinating the clock 16 with clothing, and first apparatus 18 for interchangeably maintaining the clock 16 in the pocket 14.

The handbag 12 comprises a rear panel 20 for facing a user, a front panel 22 that opposes the rear panel 20 and has an external surface 24 for facing the ambient, a bottom panel 26 extending forwardly from the rear panel 20 to the front panel 22, and a pair of accordion gussets 28 extending upwardly from the bottom panel 26 and forwardly from the rear panel 20 to the front panel 22.

The rear panel 20, the front panel 22, and the pair of accordion gussets 28 together define an open top 30 of the handbag 12.

The handbag 12 further comprises a flap 32 that extends forwardly from the rear panel 20, to a front portion 34 that is in selective engagement with the front panel 22, and when the front portion 34 of the flap 32 is engaged with the front panel 22, the open top 30 of the handbag 12 is closed by the flap 32.

The handbag 12 further comprises a pair of side loops 36 that extend upwardly, respectively, from the pair of accordion gussets 28.

The handbag 12 further comprises an adjustable shoulder strap 38 that is captured in the pair of side loops 36.

The handbag 12 further comprises second apparatus 40 for selectively maintaining the front portion 34 of the flap 32 engaged with the front panel 22.

The second apparatus 40 includes the front portion 34 of the flap 32 having a throughbore 42 that is disposed centrally therethrough.

The second apparatus 40 further includes a first eyelet 44 that defines the throughbore 42 in the flap 32.

The second apparatus 40 further includes a back plate 46 that is disposed on the external surface 24 of the front panel 22.

The second apparatus 40 further includes a turn-lock 48 that extends forwardly from the back plate 46, and when achieving a locked position, passes through, and is turned to engage against, the first eyelet 44 in the flap 32 so as to maintain the flap 32 in engagement with the front panel 22, and when achieving an unlocked position, is turned to release from, and pass out of, the first eyelet 44 so as to release the flap 32 from engagement with the front panel 22.

The pocket 14 extends along the external surface 24 of the front panel 22.

The pocket 14 has an open top 50 that is selectively maintained between the front panel 22 and the front portion 34 of the flap 32.

The first apparatus 18 includes the pocket 14 having a throughopening 52 in proximity to, but separate from, the open top 50 thereof.

The first apparatus 18 further includes a second eyelet 54 that defines the throughopening 52 in the pocket 14 and allows the turn-lock 48 to pass therethrough and through the first eyelet 44, and when the turn-lock 48 is then turned, the open top 50 of the pocket 32 is maintained closed between the front panel 22 and the front portion 34 of the flap 32 so as to maintain the clock 16 in the pocket 14 even when the handbag 12 is turned upside down, and when the turn-lock 48 is then unturned and passed out of the first eyelet 44 and the second eyelet 54, the open top 50 of the pocket 14 is allowed to be opened so as allow interchanging of the clock 16.

It will be understood that each of the elements described above, or two or more together, may also find a useful application in other types of constructions differing from the types described above.

While the invention has been illustrated and described as embodied in a handbag having an external transparent pocket with an interchangeable clock therein and visible therethrough, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An accessory for clothing, comprising:

a) a handbag comprising:

i) a rear panel for facing a user;

ii) a front panel opposing said rear panel and having an external surface for facing the ambient;

iii) a bottom panel extending forwardly from said rear panel to said front panel;

iv) a pair of accordion gussets extending upwardly from said bottom panel and forwardly from said rear panel to said front panel; said rear panel, said front panel, and said pair of accordion gussets together defining an open top of said handbag;

v) a flap extending forwardly from said rear panel, to a front portion being in selective engagement with said front panel, and when said front portion of said flap is engaged with said front panel, said open top of said handbag is closed by said flap; and vi) engagement means for selectively maintaining said front portion of said flap engaged with said front panel; said engagement means including:

1) said front portion of said flap having a throughbore that is disposed centrally therethrough;

2) a first eyelet defining said throughbore in said flap;

3) a back plate disposed on said external surface of said front panel; and 4) a turn-lock extending forwardly from said back plate, and when achieving a locked position, passes through, and is turned to engage against, said first eyelet in said flap so as to maintain said flap in engagement with said front panel, and when achieving an unlocked position, is turned to release from, and pass out of, said first eyelet so as to release said flap from engagement with said front panel;

b) a pocket being transparent and disposed externally on said handbag; said pocket having an open top being selectively maintained between said front panel and said front portion of said flap;

c) a clock maintained in said pocket and visible therethrough; said clock being interchangeably maintained in said pocket for coordinating said clock with the clothing; and d) first means for interchangeably maintaining said clock in said pocket; said first means including said pocket having a throughopening in proximity to, but not separate from, said open top thereof.

2. The accessory as defined in claim 1, wherein said handbag further comprises a pair of side loops that extend upwardly, respectively, from said pair of accordion gussets.

3. The accessory as defined in claim 2, wherein said handbag further comprises an adjustable shoulder strap that is captured in said pair of side loops.

4. The accessory as defined in claim 1, wherein said pocket extends along said external surface of said front panel.

5. The accessory as defined in claim 1, wherein said first means further includes a second eyelet that defines said throughopening in said pocket and allows said turn-lock to pass therethrough and through said first eyelet, and when said turn-lock is then turned, said open top of said pocket is maintained closed between said front panel and said front portion of said flap so as to maintain said clock in said pocket even when said handbag is turned upside down, and when said turn-lock is then unturned and passed out of said first eyelet and said second eyelet, said open top of said pocket is allowed to be opened so as allow interchanging of said clock.

* * * * *